US009538270B2

(12) United States Patent
Tatini

(10) Patent No.: US 9,538,270 B2
(45) Date of Patent: Jan. 3, 2017

(54) SPEAKER

(71) Applicant: H.P. SOUND EQUIPMENT S.P.A., San Piero a Sieve-Florence (IT)

(72) Inventor: Alessandro Tatini, Fiesole-Florence (IT)

(73) Assignee: H.P. SOUND EQUIPMENT S.P.A., San Piero a Sieve-Florence (IT)

( * ) Notice: Subject to any disclaimer, the term of this patent is extended or adjusted under 35 U.S.C. 154(b) by 0 days.

(21) Appl. No.: 14/429,790

(22) PCT Filed: Oct. 9, 2013

(86) PCT No.: PCT/IT2013/000274
§ 371 (c)(1),
(2) Date: Mar. 20, 2015

(87) PCT Pub. No.: WO2014/057509
PCT Pub. Date: Apr. 17, 2014

(65) Prior Publication Data
US 2015/0237427 A1 Aug. 20, 2015

(30) Foreign Application Priority Data
Oct. 13, 2012 (IT) ..... FI20120061 U

(51) Int. Cl.
*H04R 1/02* (2006.01)

(52) U.S. Cl.
CPC ..... *H04R 1/02* (2013.01); *H04R 2201/023* (2013.01)

(58) Field of Classification Search
CPC ..... H04R 1/02; H04R 2201/23
USPC ..... 381/388, 333, 334, 303
See application file for complete search history.

(56) References Cited

U.S. PATENT DOCUMENTS 5,109,421 A * 4/1992 Fox ..... H04R 1/02 2/338
5,455,749 A 10/1995 Ferber
2002/0196959 A1 12/2002 Gurner

FOREIGN PATENT DOCUMENTS

WO 2006/114767 A1 11/2006

OTHER PUBLICATIONS

International Search Report, dated Feb. 4, 2014, from corresponding PCT application.

* cited by examiner

*Primary Examiner* — Sunita Joshi
(74) *Attorney, Agent, or Firm* — Young & Thompson

(57) ABSTRACT

Disclosed is an acoustic speaker (1) including a plurality of loudspeakers (10), a flexible element (2) for supporting the loudspeakers, and a flexible sheath (5) for external coating of the loudspeakers and the flexible supporting element.

15 Claims, 2 Drawing Sheets

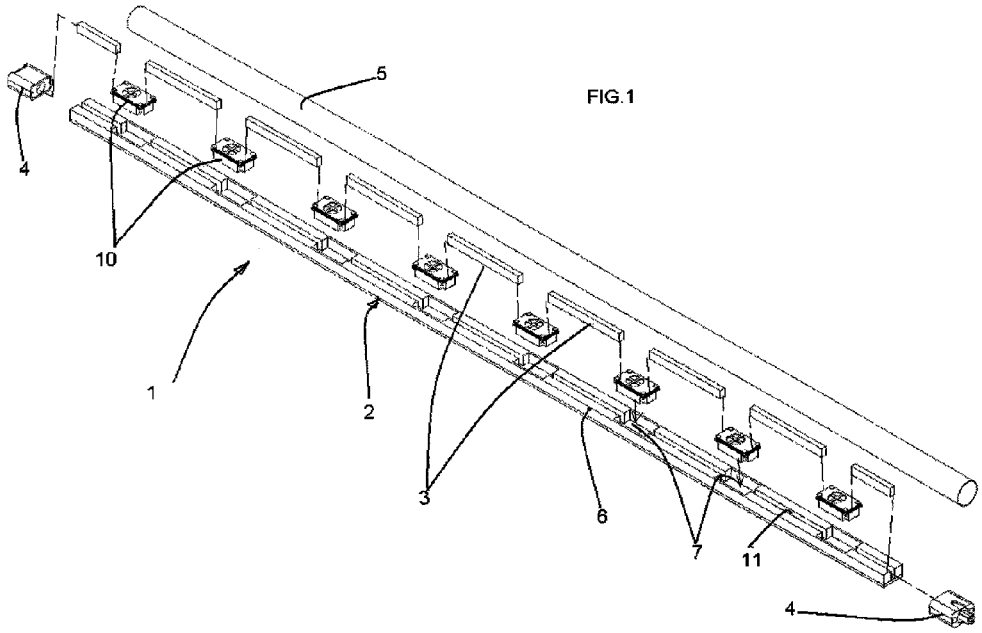
FIG.1
FIG.2
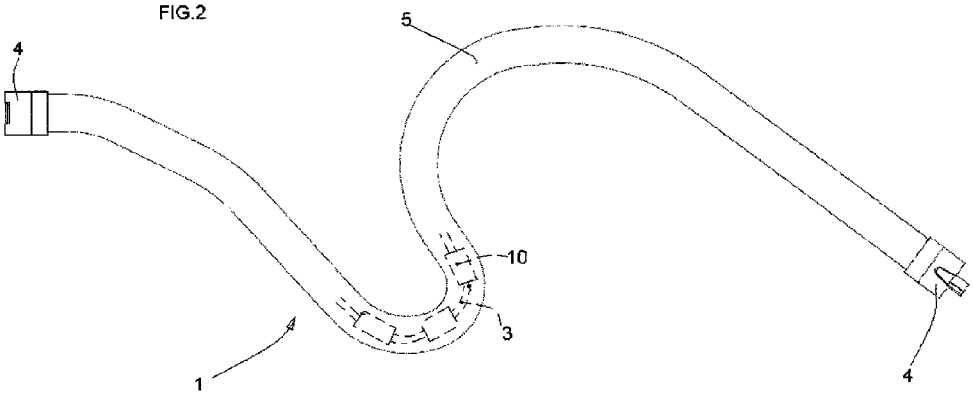

SPEAKER

TECHNICAL SECTOR

The present invention relates to a speaker of the type comprising a plurality of loudspeakers arranged in line.

PRIOR ART

Many examples of linear speakers are known of the type used for diffusion of sound in closed environments or in the open.

This type of speakers is generally constituted by a rigid rectilinear container, housed within which is a certain number of loudspeakers.

Speakers with this configuration are commonly wall-mounted or mounted on appropriate pedestals and oriented so as to emit the sound in the desired directions.

There are moreover known linear speakers comprising a number of rigid containers connected together.

These speakers find application where it is desirable to orient differently the cone of acoustic emission of the loudspeakers, for example at different heights with respect to the audience.

Known speakers are consequently of a rigid type and have a rectilinear geometry, but cannot assume a curved geometry of variable shape.

The limits of the systems of a known type hence entail the impossibility of using acoustic speakers in those applications that require curved geometries and the capacity to adapt to different shapes during use.

For instance, in one and the same circumstance it may be desirable to apply one and the same speaker to a curvilinear wall and subsequently to a linear wall.

In a different application, it would be desirable for the musician to be able to wear the speaker in order to have an immediate acoustic feedback.

OBJECT OF THE INVENTION

The object of the present invention is to overcome the drawbacks of the known art by proposing a portable acoustic speaker having a shape that can be adapted to the circumstances.

SUMMARY OF THE INVENTION

The above purposes are achieved by a portable speaker with flexible geometry according to at least one of the annexed claims.

A first advantage consists in the possibility of adapting the speaker to supports of different geometry.

A second advantage consists in the possibility for a musician to wear the speaker in the form of a belt or shoulder strap.

LIST OF THE DRAWINGS

The above and further advantages will be understood by any person skilled in the branch from the ensuing description and from the annexed drawings, wherein:

FIG. 1 shows an exploded view of the speaker of the invention;

FIG. 2 shows the speaker of FIG. 1 in curvilinear configuration;

DETAILED DESCRIPTION

Figure 3:
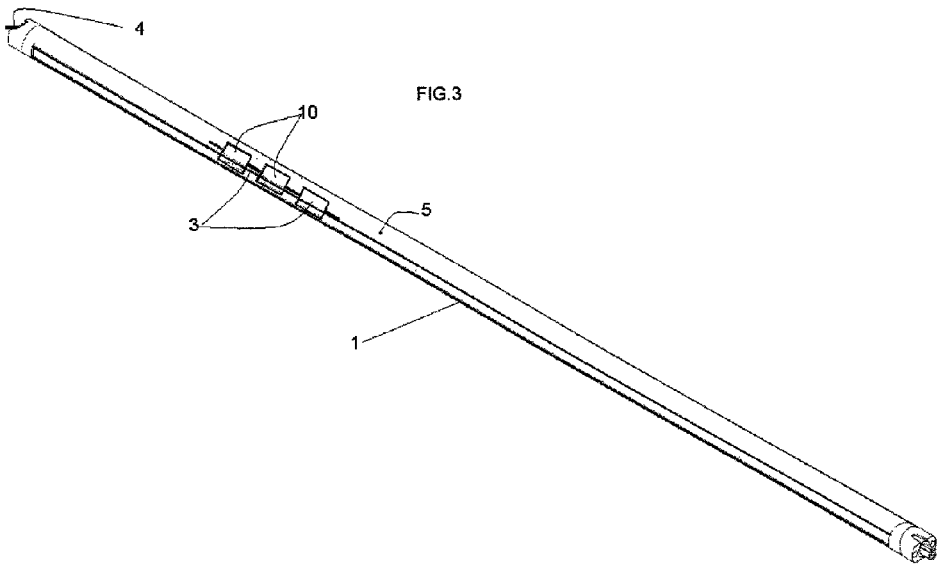
FIG. 3 shows the speaker of FIG. 1 in rectilinear configuration.

With reference to the drawings, described herein is an acoustic speaker 1 comprising a plurality of loudspeakers 10 arranged in line and connected together by means of intermediate electrical connections, for example flexible cables, provided with end connections 4 for connection to an acoustic system and/or to further speakers in the case of a modular arrangement.

The connections 3, 4 are of a type in itself known for connection of acoustic speakers, and are hence not described in greater detail.

Preferably, the connections 3 are arranged within a protective sheath, which is also flexible.

In a preferred embodiment, according to the invention, the loudspeakers 10 are housed within seats 7 of a flexible elongated support 2 made of an elastic material, for example rubber or the like, and coated with an external flexible sheath 5 provided for protection and containment of the loudspeakers and the connections.

Preferably, the support 2 is moreover provided with further seats 11 for housing the connections 3.

The speaker presents numerous advantages because it is able to assume in a flexible way curved conformations (FIG. 3) and hence adapt to applications that require a non-rectilinear shape of the speaker.

Figure 4:
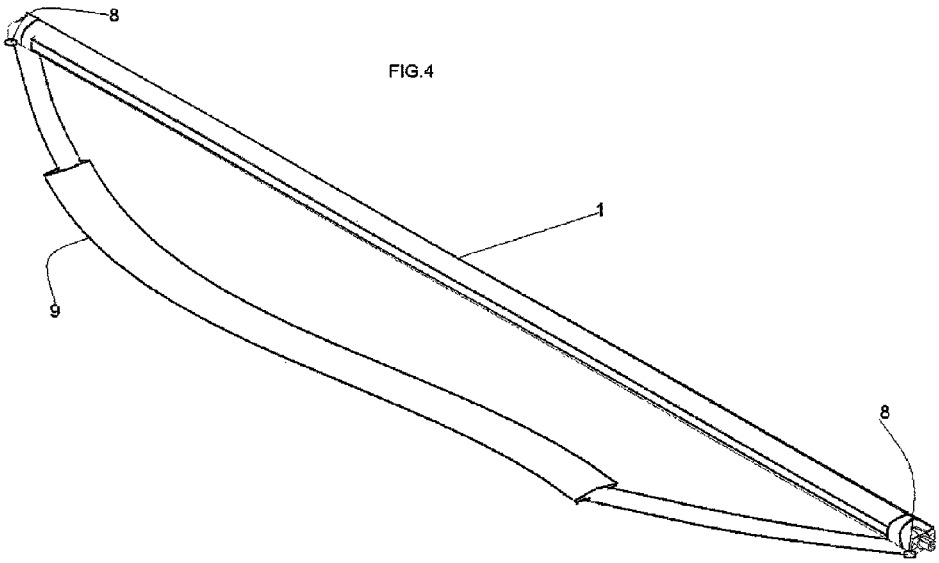
FIG. 4 shows the speaker of FIG. 1 provided with a shoulder strap.

In addition, the speaker may be sized for portable use and in this case may comprise fixing means 8, for example hooks arranged at the ends of the speaker, for connecting belts or straps 9 that can be worn by a user (FIG. 4), for example a musician.

The present invention has been described according to preferred embodiments, but equivalent variants may be devised without thereby departing from the sphere of protection granted.

The invention claimed is:

1. A speaker(1), comprising:

a plurality of loudspeakers (10);

a flexible elongated support (2) connecting the loudspeakers in a line of connected loudspeakers;

intermediate electrical connections (3) between said loudspeakers that electrically connect the loudspeakers together;

first and second terminal electrical interfaces (4) located respectively at first and second ends of the line of connected loudspeakers, said terminal electrical interfaces (4) being electrical connections arranged for connecting plural of said speaker in a modular way; and a flexible sheath (5) externally coating said loudspeakers, and said flexible elongated support (2), wherein the sheath (5) is a hollow tubular body made of flexible material.

2. The speaker according to claim 1, wherein said flexible elongated support (2) comprises a common support (6).

3. The speaker according to claim 2, wherein said common support is constituted by an elongated body made of elastic material provided with seats (7), each seat precisely housing a respective one of said loudspeakers.

4. The speaker according to claim 1, wherein said flexible elongated support (2) comprises an elongated body made of elastic material provided with seats (11) for housing said intermediate electrical connections precisely.

5. The speaker according to claim 1, comprising fixing means (8) consisting of belts (9) or straps that can be worn to render the speaker portable for a user.

6. The speaker according to claim 3, wherein said flexible elongated support (2) comprises an elongated body made of elastic material provided with seats (11) for housing said intermediate electrical connections precisely.

7. The speaker according to claim 2, comprising fixing means (8) consisting of belts (9) or straps that can be worn to render the speaker portable for a user.

8. The speaker according to claim 3, comprising fixing means (8) consisting of belts (9) or straps that can be worn to render the speaker portable for a user.

9. The speaker according to claim 4, comprising fixing means (8) consisting of belts (9) or straps that can be worn to render the speaker portable for a user.

10. The speaker according to claim 1, wherein, the flexible sheath (5) externally coats said loudspeakers, said intermediate electrical connections (3), and said flexible elongated support (2), and the first and second terminal electrical interfaces (4) are located respectively at first and second ends of the flexible sheath (5).

11. The speaker according to claim 10, wherein, said flexible elongated support (2) comprises an elongated body of elastic material (6) provided with seats (7), each seat housing a respective one of said loudspeakers.

12. The speaker according to claim 11, wherein said flexible elongated support (2) further comprises further seats (11), each further seat (11) housing a respective one of said intermediate electrical connections.

13. The speaker according to claim 10, further comprising first and second fixing elements (8) connected to one of the group consisting of a belt and a strap that can be worn by a user to render the speaker portable with the speaker taking a non-rectilinear shape.

14. The speaker according to claim 13, wherein the first and second fixing elements (8) are located respectively at first and second ends of the flexible sheath (5).

15. The speaker according to claim 10, wherein said intermediate electrical connections (3) are comprised of flexible cables.

* * * * *